US005469591A

United States Patent [19]

Nomura

[11] Patent Number: 5,469,591

[45] Date of Patent: Nov. 28, 1995

[54] BOTTOM STRUCTURE FOR A BED

[75] Inventor: Katsuyoshi Nomura, Chiba, Japan

[73] Assignee: Paramount Bed Company Limited, Tokyo, Japan

[21] Appl. No.: 301,408

[22] Filed: Sep. 8, 1994

[30] Foreign Application Priority Data

Sep. 8, 1993 [JP] Japan ..... 5-223742

[51] Int. Cl.[6] ..... A61G 7/04

[52] U.S. Cl. ..... 5/613; 5/171; 5/617; 5/236.1

[58] Field of Search ..... 5/236.1, 238, 613, 5/191, 465, 617, 618

[56] References Cited

U.S. PATENT DOCUMENTS

| | | | |
|---|---|---|---|
| 2,571,337 | 10/1951 | Burnham | 5/191 |
| 3,717,376 | 2/1973 | Lutchansky | 5/236 |
| 3,843,278 | 11/1974 | Propst | 5/465 X |
| 4,644,596 | 2/1987 | Husler | 5/191 X |
| 4,827,544 | 5/1989 | Husler | 5/236.1 |
| 5,060,326 | 10/1991 | Oswald | 5/236.1 |
| 5,109,554 | 5/1992 | Borders et al. | 5/618 X |
| 5,222,263 | 6/1993 | Magistretti | 5/465 |

FOREIGN PATENT DOCUMENTS

| | | | |
|---|---|---|---|
| 465443 | 5/1925 | Germany | 5/216.1 |

*Primary Examiner*—Michael F. Trettel
*Attorney, Agent, or Firm*—Townsend & Banta

[57] ABSTRACT

It is the object of the present invention to present a bottom structure which allows a bed bottom to be bent at desired curvatures. This is achieved using a bendable bottom component 6 located between the back and waist portions and/or waist and leg portions of a bed bottom 2 which is comprised of parallel rigid strips 7 and flexible strips 8 located between the respectively adjacent rigid strips 7. The flexible strips 8 are formed as bendable sheets 9 connecting the respectively adjacent rigid strips 7 on the side to form the inside curve of the bottom. Guard rails 10 are provided longitudinally to cover both the ends, in the width direction of the bed, of the bendable bottom component 6. End contacts 11 of the guard rails 10 are engaged with the rigid strips 7, and have end caps 12 attached. The end contacts 11 are adjustable and connected with each other by connecting rods 15. The end caps 12 are formed to be thinner at the overlapped portions than the other portions. The result is that the ends of the bendable bottom component in the width direction of the bed can be always covered with guard rails, to keep fingers and things away from being caught by any mistake. Moreover, since the bendable bottom component can be bent to draw a controlled curve no displeasing feeling of pressure is given to the patient when the bed bottom is bent.

25 Claims, 5 Drawing Sheets

BOTTOM STRUCTURE FOR A BED

BACKGROUND OF THE INVENTION

1. Field of the Invention

The present invention relates to a bottom structure for a bed which can be bent to a desired curvature at a desired point without causing any displeasing feeling of pressure to a patient lying on the bed.

2. Description of the Related Art

Many recent beds have been equipped with a bottom bending mechanism and various mechanisms are available. A typical prior art bed has a back bottom portion and a waist bottom portion simply connected with each other at one point or occasionally in addition, a waist bottom portion and a leg bottom portion also simply connected with each other at one point. When the back portion is inclined, the joint between the back and waist portions operates as a pivot, i.e., as an actual fulcrum. When the leg portion is inclined the joint between the waist and leg bottom portions also acts as a pivot.

Therefore, when the back bottom portion is inclined up to a certain angle, the space between the back and waist bottom portions near the joint is narrowed, and unless the bent portion of the bottom actually fits that patient's body as he lays his waist, abdomen and legs are uncomfortably pressed by the underside by the mattress.

The present invention has been achieved to solve the above cited problem. The object of the present invention is to provide a bottom structure of a bed, having length and width, which can be bent in a desirable curvature, to keep the bent portion gently curved to secure a space at the bent portion, which eases feeling of pressure to any size patient which might be displeasing.

SUMMARY OF THE INVENTION

The present invention solves the above cited problem by using a bottom structure for a bed having a bottom bending mechanism and comprising a bendable bottom component at each appropriate bendable portion of the bottom, wherein said bendable bottom component consists of plural parallel rigid strips and longitudinally expandable parallel flexible strips located between the adjacent sides of the rigid strips; and wherein said flexible strips are connecting the sides of the respective adjacent rigid strips. The top side of the rigid strips may also be formed to include a sheet and thus completing the inside curve of the bottom component. Further, the flexible strips may be formed so as to be folded in a V-shape on the side of the bottom structure which forms the inside curve when the bottom structure is bent. The flexible strips may also be longitudinally expandable flexible sheets.

As stated above, a bottom structure for a bed is generally comprised of three portions, namely a back, bottom and leg portion. The present invention presents a bottom structure for a bed as stated above wherein the bendable bottom component is provided in the bottom structure at a position between the back position and the bottom position, corresponding to the waist. Further, the bottom structure the bendable bottom component is provided at a position between the back portion and the leg portion corresponding to the knees.

The present invention also presents a bottom structure for a bed, as stated above, further comprising guard rails which are provided longitudinally to contact the bendable bottom component at both ends of the rigid strips of the bottom component and located at the width section of the bed; wherein said guard rails consist of end contacts engaged with the ends of the respective rigid strips and adjustable end caps. The end contacts are connected with each other so that they can follow the bending motion of the flexible strips and sustain the bent state of the bottom; and the respective adjacent end caps are overlapped with each other at their ends such that they can be respectively dislocated and adjusted to changes in the longitudinal length of the bottom component as the bottom structure is lifted and lowered.

Figure 1:
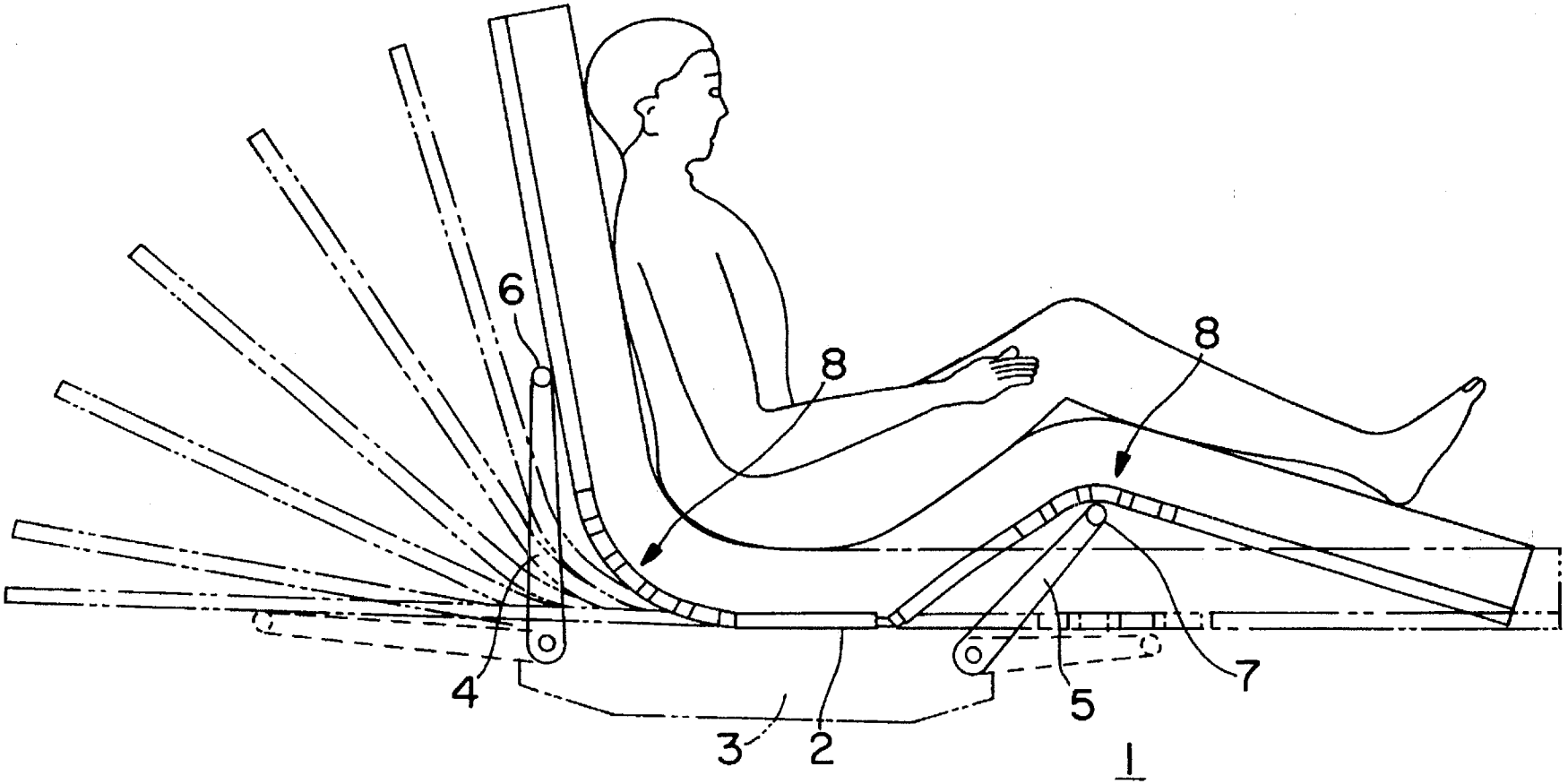
FIG. 1 is an example of a side illustration showing a section of a bed to which the bottom structure of the present invention is applied.

In the Figures, the numbers represent the following structures:

1 . . . bed; 2 . . . bottom structure; 3 . . . actuator; 4 . . . back lifting arm 5 . . . leg lifting arm; 6,7 . . . roller; 8 . . . bendable bottom component; 9 . . . rigid strip; 10 . . . flexible strip; 11 . . . sheet; 12 . . . guard rail; 13 . . . end contact; 13A . . . screw; 14 . . . end cap; 15 . . . main body; 16 . . . cover; 17 . . . connecting rod 18*a*, 18*b* . . . loose groves; 19 . . . engaging portion; 20 . . . joint 21 . . . bendable portion; 22 . . . other or nonbendable portion.

DETAILED DESCRIPTION

The present invention is a bottom structure for a bed having a bottom bending mechanism and comprising a bendable bottom component at the appropriate bendable portion of the bottom, wherein said bendable bottom component consists of plural parallel rigid strips and flexible strips located between the adjacent sides of the rigid strips. The flexible strips are preferably longitudinally expandable flexible strips. The strips preferably include bendable sheets connecting the respective adjacent rigid strips on the side which forms the inside curve of the bottom structure when lifted or lowered. Further, the flexible strips may be formed so as to be folded in a V-shape when the bottom structure is bent, forming a curve in the bottom structure.

As stated above, a bottom structure for a bed is generally comprised of three portions, namely a back, bottom and leg portion. The present invention presents a bottom structure for a bed as stated above wherein the bendable bottom component is provided in the bottom structure at a position between the back position and the bottom position, corresponding to the waist. Further, the bottom structure the bendable bottom component is provided at a position between the back portion and the leg portion corresponding to the knees.

The bottom structure for a bed may include rigid strips, preferably hollow and preferably made of synthetic resin and flexible strips which are formed so as to be thinner at their central portions and at the portions to be connected with the rigid strips. The portion connected to the rigid strip (joint) and the central portion of the flexible strip may also be made of a material softer than that of the rest of the sheet. The rigid strips and the flexible strips may be manufactured or formed as a single integrated unit, or formed separately and then connected.

The bendable sheets can also be configured so as to be V-shaped and flexible. The bendable sheet can be connected to either the top or bottom side of the rigid strips of the bendable bottom component, so as to be on the inside of the curve formed when the bottom structure is bent. For example, when the bottom structure is lifted or bent, forming a curve on the top side of the bendable bottom component, the bendable sheets of the flexible strips are located between the top side of the respective adjacent rigid strips. The bendable sheets can be compressed into a V-shape. The flexible sheet are gradually elongated at the bottom surface of the bendable bottom component, to gradually widen the spaces between the respectively adjacent rigid strips. They also gradually compressed, forming a narrow space between the respective adjacent rigid strips on the top surface of the bendable bottom component. As a result, the bendable bottom component forms a smooth and gentle curve on the side in contact with the patient. The rigid strips provide support to the bottom component and either the flexible strips, the bendable sheets or the combination, provide the bendable dynamics of the bottom component. As a result, the bendable bottom component forms a smooth and gentle curve.

The bottom structure can also be provided with guard rails running longitudinally which can cover the ends located at the width section of the bed of the bendable bottom component. The guard rails consist of end contacts engaged with the ends of the respective rigid strips, and end caps. The end contacts are connected with each other so that they can follow the bending motion of the flexible strips and sustain the bent state of the bottom; and the respective adjacent end caps are designed to be dislocated but remain overlapped with each other at their ends.

The end contacts may be constructed of a main body and a cover. The cover is preferably connected to the main body with screws. The adjacent end contacts preferably have an adjustable connection with each other through the use of connecting rods. The connecting rods are loosely engaged in loose grooves formed along two virtually parallel lines in the main bodies. Both ends of the connecting rods are bent and thus the distance the rods can move is limited as the rods are stopped from moving within the grooves when the bent portion of the rod abuts the end of the grooves. Each of the main bodies has an engaging portion which connects the end contacts to the end caps. In one embodiment, the adjacent end caps are preferably shaped in a Z-like form. The end caps are formed to be thinner at the portion that overlaps the adjacent end cap (the top and bottom section of the Z-like form embodiment). The top section of the Z-like form overlaps with the bottom section of the Z-like form of the adjacent end cap. The adjacent end caps may abut with each other such that the guard rails are flush on the outer surface.

The ends of the rigid strips in the width direction of the bed may be engaged with the end contacts of guard rails, and the respective adjacent end caps are adjustable so they can be dislocated and overlapped with each other at their ends. Thus when guard rails are used, the rigid strips and the flexible strips are always covered at the bottom surface and at the ends of the rigid strips located at the width section of the bed. As a result of the guard rails, fingers and other things are kept away form being caught between the strips by accident.

Moreover, it is preferable that the end contacts of the guard rails are mutually connected and arrested to be able to follow the bending motion of the flexible strips and to prevent the bendable bottom component from becoming uneven due to the weight of the rigid strips. Thus, the bendable bottom component can be bent while sustaining a controlled curve.

Since the bendable bottom component can be bent to draw a smooth and gentle curve, it does not happen that the space at the bent portion is narrowed excessively or sharply to form a displeasing folding pressure at the waist and the abdomen of the patient or the waist and legs of the patient. Furthermore, a result of the present invention is that the patient is shifted less as the bottom structure of the bed is lifted and lowered.

EXAMPLES

The bottom structure for a bed of the present invention is describe below in reference to the attached drawings showing examples.

FIG. 1 shows a bed 1, to which the bottom structure of the present invention is applied. The bed 1 can make the bottom 2 incline on the back portion and the leg portion using an electric actuator 3 provided below the bottom 2. The actuator 3 is provided with back lifting arms 4 for lifting the back potion and leg lifting arms 5 for lifting the leg portion. The back lifting bars 4 contact the bottom 2 on the under side at a portion corresponding to the back portion, through rollers 6, while the leg lifting arms 5 contact the bottom 2 on the underside at a portion corresponding to the leg portion, through rollers 7.

In this bed 1, the bendable bottom components 8 are located at a portion corresponding to the bendable portion of the bottom 2 between the back and waist portions and at any other portion corresponding to the bendable portion of the bottom 2, such as the leg portion. Each of the bendable bottom components 8 consists of plural parallel rigid strips 9 and longitudinally expandable parallel flexible strips 10 located between the respectively adjacent rigid strips 9 (see FIGS. 2, 3 and 4). Optionally, the bottom structure may include a hinge if the material comprising the bottom structure is too rigid or otherwise improves the function of the bed.

Figure 2:
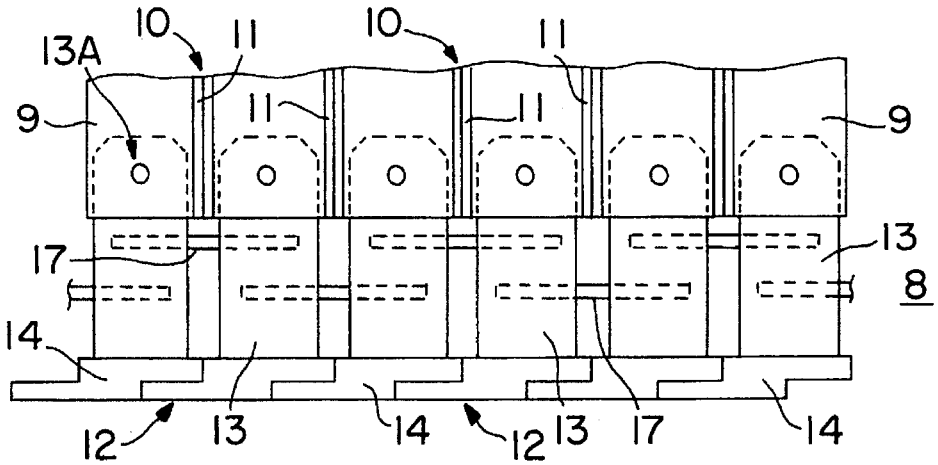
FIG. 2 is a bottom view of a sectional illustration of an expandable section of one example of a bendable bottom component and guard rail at the bendable section of the bottom structure shown in FIG. 1.
Figure 3:
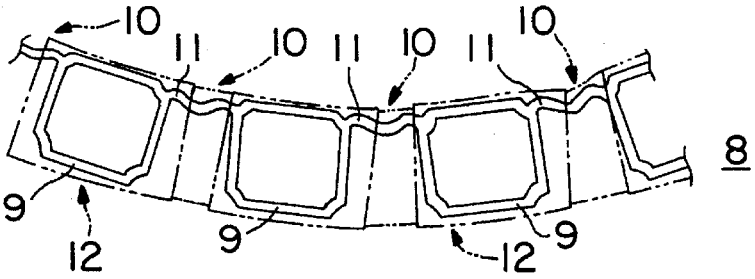
FIG. 3 is a schematic sectional illustration showing another example of a structure of the end of the bendable bottom component shown in FIG. 1.
Figure 4:
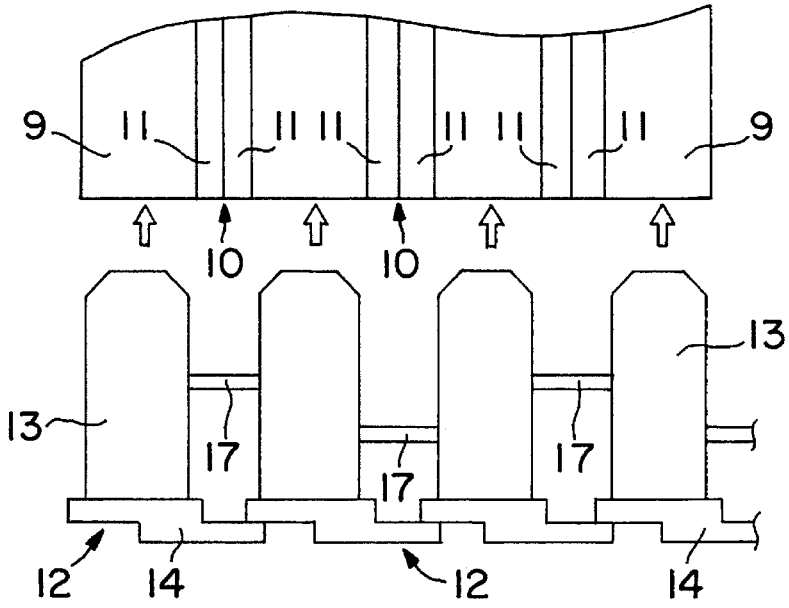
FIG. 4 is a top view of a sectional illustration showing an end configuration of another example of a bendable bottom component and guard rail shown in FIG. 1 prior to the combination of the bendable bottom component and the guard rail.
Figure 8A:
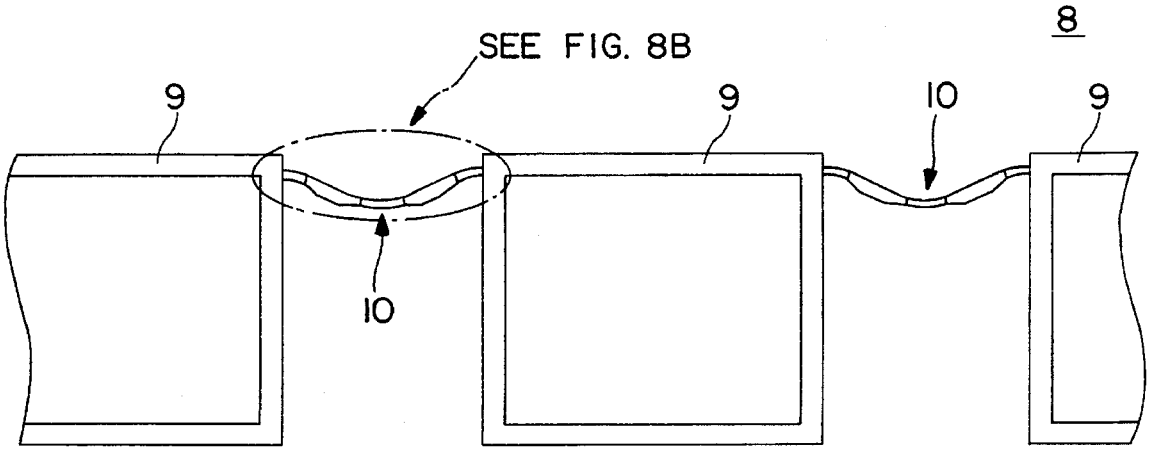
FIG. 8 is a schematic sectional illustrations of the end face (side) showing an other example of a structure of the bendable component having rigid strips and connecting flexible strips.
Figure 8B:
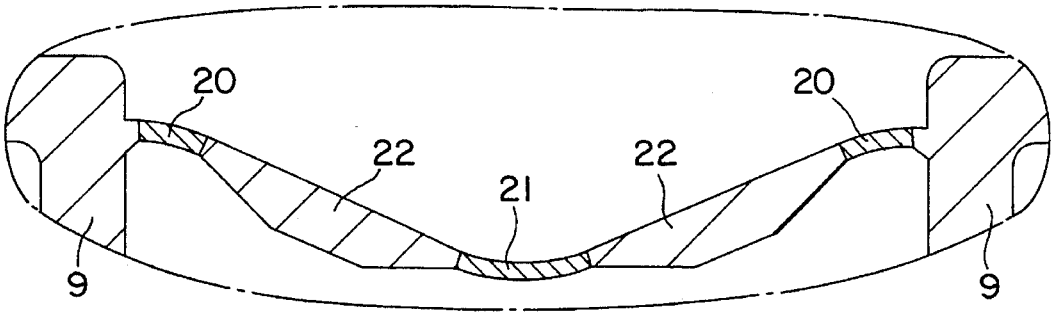

The rigid strips 9 are preferably extrusion-molded hollow strips made of a synthetic resin and can be formed to be integral with the flexible strips (see FIGS. 3 and 4). Further, the flexible strips 10 can also be formed with reinforced bendable sheets 11 connecting the respective adjacent rigid strips 9 on the side to form the inside curve of the bottom 2 (see FIG. 3). The bendable sheets 11 are formed to be thinner at their central portions 21 and at the portions to be connected with the rigid strips 20 than at the other potions of the bendable sheets 11 so that the bendable sheets 11 can be bent inside at the respective central portions 21 (see FIGS. 8A and 8B). The bendable bottom component 8 can also have a structure in which the rigid strips 9 and the flexible strips 10 are molded separately and are then connected (see FIG. 2).

The ends, located on width section of the bed, of the rigid strips 9 of the bendable bottom component 8 are engaged with the end contacts 13 of the guard rails 12, and the end contacts 13 have the end caps 14 attached (see FIGS. 2 and 4). The rigid strips 9 are preferably engaged with the end contacts 13 using a screw 13A.

Figure 5A:
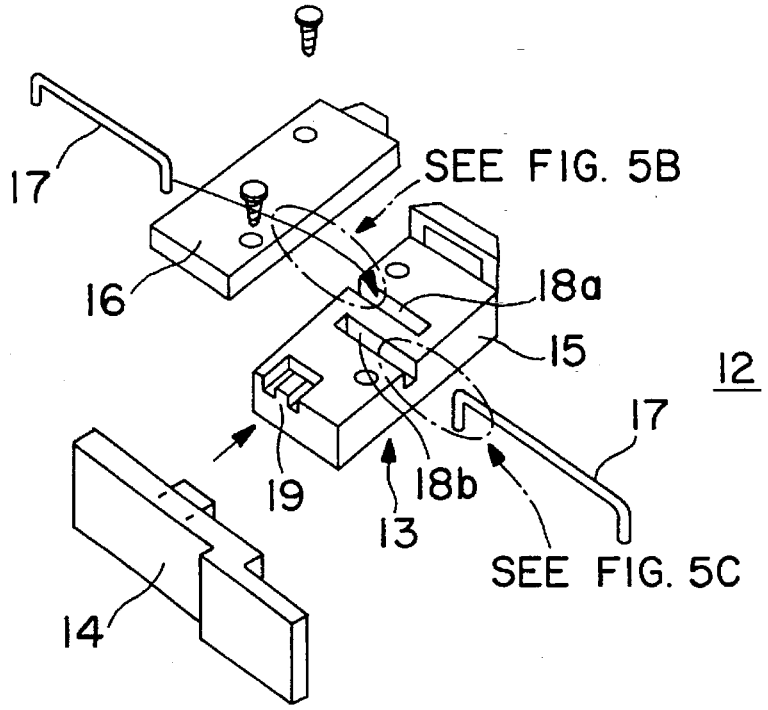
FIG. 5 is an exploded perspective illustration showing one example of the structure of a guard rail which can be attached to the end of the bendable bottom component shown in FIGS. 2, 3 or 4.
Figure 5B:
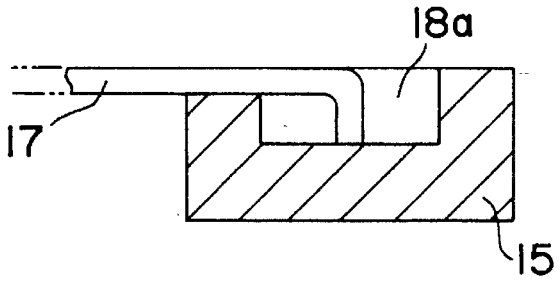
Figure 5C:
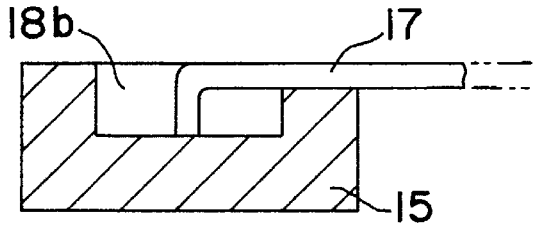

In examples where extra support is preferable the end contacts include connecting rods 17. In one example the end contacts 13 have a cover 16 screwed to a main body 15 (see FIG. 5). The respective adjacent end contacts 13 are connected but can be separated from each other through the use of connecting rods 17. The connecting rods 17 are loosely engaged with loose grooves 18*a* and 18*b* formed along two virtually parallel lines in the main bodies 15. Each of the connecting rods 17 has at both ends a bend to control the movable distance in the loose grooves 18*a* and 18*b*. Each of the main bodies 15 has an engaging portion 19 to be engaged with each of the end caps 14.

The end caps 14 are preferably formed to be thinner at the portion to be overlapped with the respective adjacent end caps 14, so that the respective adjacent end caps 14 may be flush with each other to make the guard rails flat on the bottom or outer faces.

Figure 6:
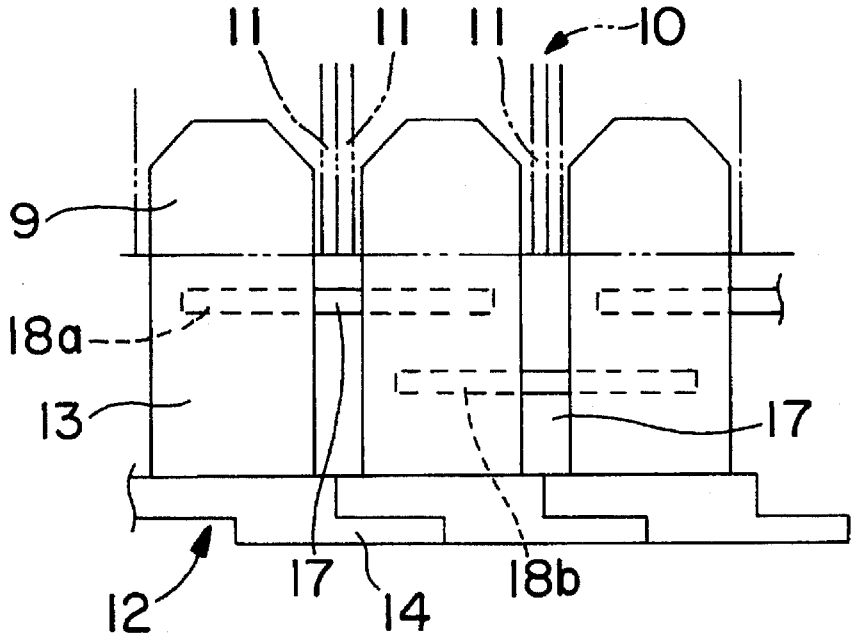
FIG. 6 is a top view of a schematic illustration showing the connection of another example of a guard rail which can be attached to the bendable bottom component while the bottom component is in its flat state.
Figure 7:
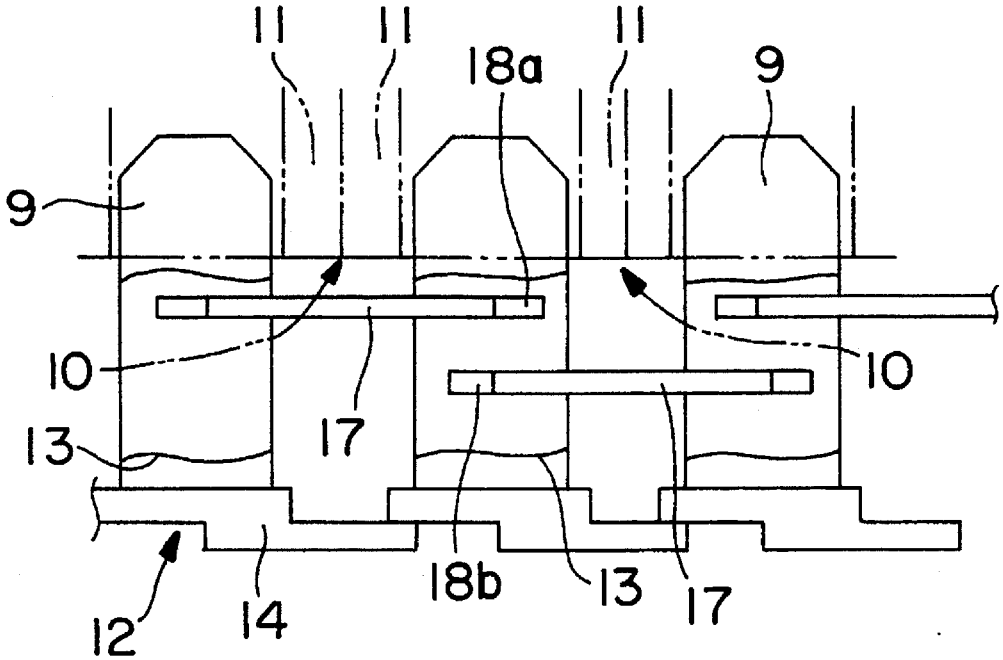
FIG. 7 is a top view of a schematic illustration showing the connection of the guard rail shown in FIG. 6 when the bottom component is expanded or bent.

In the bed 1 shown in FIG. 1 with the above bottom component applied, if the bottom structure 2 is bent by starting the actuator 3, the bendable sheets 11 of the flexible strips 10 located between the respective adjacent rigid strips 9 are gradually compressed into a V-shape in the bendable bottom component 8. Also the flexible strips 10 are compressed and gradually narrow the spaces between the respective adjacent rigid strips 9. As a result, the bendable bottom component 8 is compressed and forms a smooth and gentle curve on the side of the bendable sheets 11 connecting the respectively adjacent rigid strips 9 (see FIG. 3). If the bendable bottom component is further comprised of guard rails, the rails are located longitudinally beneath the rigid strips 9 and flexible strips 10 along the length section of the bed. The rigid strips 9 are engaged with the end contacts 13 of the guard rails 12 at the ends of the strips located at the width section of the bed (see FIGS. 2, 6 and 7). The connecting rods 17 move loosely in the grooves 18*a* and 18*b* of the main bodies 15 of the end contacts 13 of the guard rails 12. So, the respective adjacent end contacts 13 of the guard rails 12 move apart from each other as the bed is lifted upwards and the flexible strips 10 are stretched apart. As a result, the end caps 14 are dislocated at the mutually overlapped portions.

Even if the end caps 14 are dislocated till respectively both the bent ends of the connecting rods 17 are brought into contact with the ends of the loose grooves 18*a* and 18*b* of the main bodies 15, the end caps 14 remain overlapped with each other at their ends. So, the rigid strips 9 and the flexible strips 10 are always kept covered with the guard rails 12, to keep fingers things away from being caught by any accident (see FIG. 7).

Furthermore, as described before, since the end contacts 13 of the guard rails 12 are connected and arrested with each other in such a manner that they can be adjustable relocated to follow the bending motion of the flexible strips 10 till both the bent ends of the connecting rods 17 are brought into contact with the ends of the loose grooves 18*a* and 18*b* of the main bodies 15, the bendable bottom component 8 is prevented from dropping due to the weight of the rigid strips 9 and can be bent to sustain a controlled curve (see FIG. 1).

Since the bendable bottom component 8 can be bent to form a smooth and gentle curve as described above, it does not result in a space being formed at the bent portion which is excessively narrowed which would cause displeasing folding pressure to the patient, and as a result the patient is relieved of pressure on his waist or abdomen and keeps his body from shifting less.

As described above, since the bendable bottom component 8 has a simple structure in which the flexible strips 10 connect the respectively adjacent rigid strips 9 preferably with bendable sheets 11, to form a comfortable curve, the bottom component can be easily produced at low cost.

In another embodiment of the present invention the bendable bottom component 8 is comprised of parallel rigid strips 9 and flexible strips 10 having joints 20 which connect the flexible strips 10 and rigid strips 9, central bendable portions 21 and other connecting portions 22. The joints 20 and central bendable portions 21 are thinner than the other portions 22 and made of any softer material (see FIG. 8A and 8B).

Furthermore if the rigid strips 9 and the flexible strips 10 are formed separately and then connected, any broken strip alone, can be easily exchanged and thus avoid waste (see FIG. 2).

As described above, the present invention presents the following advantages:

(1.) Since the bendable bottom component can be bent to the desired curvature at an appropriate bendable section of the a bed bottom, the bottom does not cause any displeasing feelings of pressure to a patient when the bed is bent.

(2.) The bendable bottom component has a simple structure comprised of flexible strips connecting respectively adjacent rigid strips in which the flexible strips can be formed to be V-shaped on the side which forms the inside curve of the bent bendable bottom component. As a result, it can be easily produced at a low cost.

(3.) Since the flexible strips 7 and rigid strips 8 can be molded separately and detachably connected, any broken strip can be easily replaced and the bottom component can be maintained at a low cost.

(4.) The ends of the rigid strips of the bendable bottom component located at the width section of the bed, can be engaged with the end contacts of the guard rails, and the respective adjacent end caps are adjustable relocated and overlapped with each other at their ends. So, the rigid strips and the flexible strips are always covered, at their ends and bottom with the guard rails, which keeps fingers and other things away from being caught by accident.

(5.) The end contacts of the guard rails are mutually connected and controlled to be able to follow the bending motion of the flexible strips and prevent the bendable bottom component from descending due to the weight of the rigid strip. Thus, the bendable bottom component can be bent to sustain a controlled curve.

What is claimed is:

1. A bottom structure for a bed with a bottom bending mechanism comprising a bendable bottom component; said bendable bottom component having a top side and a bottom side and having plural parallel adjacent rigid strips and flexible strips; said flexible strips located between and connecting said adjacent rigid strips; said flexible strips located on said top side and being extensible so as to form a curve when said bottom structure is bent and V-shaped on the side which forms an inside curve when said bottom structure is bent.

2. A bottom structure for a bed, according to claim 1, wherein said bendable bottom component is provided between a bottom component corresponding to a patient's back and a bottom component corresponding to a patient's waist.

3. A bottom structure for a bed, according to claim 2, wherein the rigid strips of said bendable bottom component are hollow strips made of a synthetic resin and the flexible strips are formed to be thinner at their central portions and at the portions to be connected with the rigid strips than at the other portions.

4. A bottom structure for a bed, according to claim 2, wherein guard rails are engaged with both ends, in the width direction of the bed, of the rigid strips of the bendable bottom component and having end contacts engaged with the ends of the rigid strips and ends caps; each of the end contacts has a cover screwed to a main body; the respectively adjacent end contacts are slidable and connected with each other through connecting rods; the connecting rods are loosely engaged with loose grooves formed along two virtually parallel lines in the main bodies; each of the connecting rods has its both ends bent to control a loosely movable distance in the loose grooves since respectively both the ends of the connecting rods are stopped by contact with the ends of the loose grooves; each of the main bodies has an engaging portion to be engaged with each of the end caps; and the end caps are formed to be thinner at the portions to be overlapped with the respectively adjacent end caps, so that the respectively adjacent end caps may be flush with each other to make the guard rails flush on the outer faces.

5. A bottom structure for a bed, according to claim 1, wherein said bendable bottom component is provided at a bottom component corresponding to a patient's knees.

6. A bottom structure for a bed, according to claim 5, wherein joints formed between the rigid strips and the flexible strips of said bendable bottom component and the central portions of the flexible strips are made of a softer material.

7. A bottom structure for a bed, according to claim 5, wherein joints formed between the rigid strips and the flexible strips of said bendable bottom component and the central portions of the flexible strips are formed to be thinner than the other portions, and are made of a softer material.

8. A bottom structure for a bed, according to claim 5, wherein the rigid strips and the flexible strips of said bendable bottom component are integrally formed.

9. A bottom structure for a bed, according to claim 5, wherein the rigid strips and the flexible strips of said bendable bottom component are formed separately and connected with each other.

10. A bottom structure for a bed, according to claim 1, wherein guard rails are provided longitudinally to cover both ends, in a width direction of said bed, of said bendable bottom component; said guard rails having end contacts engaged with said ends of said rigid strips and end caps; said end contacts are connected with each other such that they follow bending motion of said flexible strips and sustain a bent state of said bendable bottom component; and said end caps are slidable and overlapped with each other.

11. A bottom structure for a bed, according to claim 1, wherein the rigid strips of said bendable bottom component are hollow strips made of a synthetic resin and the flexible strips are formed to be thinner at their central portions and at the portions to be connected with the rigid strips.

12. A bottom structure for a bed, according to claim 11, wherein the rigid strips and the flexible strips of said bendable bottom component are integrally formed.

13. A bottom structure for a bed, according to claim 11, wherein the rigid strips and the flexible strips of said bendable bottom component are formed separately and connected with each other.

14. A bottom structure for a bed with a bottom bending mechanism comprising a bendable bottom component having plural parallel adjacent rigid strips, wherein each adjacent rigid strip has a top side, a bottom side, two end sides and two adjacent sides, and a plurality of expandable flexible strips having a top surface and a bottom surface, wherein each flexible strip is located between an adjacent side of one rigid strip and an adjacent side of a second rigid strip; and wherein said flexible strips are formed as bendable sheets which can be expanded or compressed; and wherein said flexible strip is connected to an adjacent side of one rigid strip from the top side to the bottom side of said rigid strip and connected to an adjacent side of a second rigid strip from the top side to the bottom side of said second rigid strip, whereby when said bottom structure is lifted a curve is formed in said bottom component.

15. A bottom structure for a bed according to claim 14 wherein said rigid strips are a separate unit of extrusion-molded hollow strip made of a synthetic plastic.

16. A bottom structure for a bed according to claim 14 wherein said flexible strips are a separate unit made of extrusion-molded synthetic plastic.

17. A bottom structure for a bed according to claim 14 wherein a rigid strip and a flexible strip are formed as an integral piece.

18. A bottom structure for a bed according to claim 14 wherein said bendable bottom component is formed as an integral piece.

19. A bottom structure for a bed according to claim 14 wherein said flexible strip further comprises a top surface and a bottom surface and said top surface is a reinforced bendable sheet wherein said reinforced sheet is formed to be thinner at intermediate portions and at portions that connect with said adjacent rigid strips, whereby said reinforced bendable sheet can be bent at said intermediate portions.

20. A bottom structure for a bed according to claim 14 further comprising guard rails located longitudinally beneath said bendable bottom component wherein said guard rails have a series of separate and adjacent end contacts, each end contact having an engaging means whereby said end contacts can be moved apart or together and remain separated.

21. A bottom structure for a bed with a bending mechanism comprising guard rails which are provided longitudinally along a portion of a length of said bed, wherein said guard rails have a series of separate and adjacent end contacts, each end contact having an engaging means whereby said end contacts can be moved apart or together and remain separated.

22. A bottom structure for a bed according to claim 21 wherein each end contact comprises a cover, a main body which is engaged with said cover, and at least two loose grooves formed along substantially parallel lines in the main body; and connecting rods which are movable within said grooves, each rod having an arresting means for limiting the distance the rod can move within the groove, whereby said end contacts can be moved apart or together and remain separated.

23. A bottom structure for a bed according to claim 22 wherein said grooves extend less than the entire width of the main body and said rods are bent at both ends.

24. A bottom structure for a bed according to claim 21 further comprising overlapping end caps having a top side and a bottom side, wherein the top side of each end cap is attached to an end contact and shaped such that when said end contacts are moved together said end caps are flush with each other and form a flat surface on said bottom side of said end caps.

25. A bottom structure according to claim 21 wherein said end contacts are engaged with said end sides of said rigid strips whereby the guard rail extends across said bottom side of said rigid strips and said flexible strips covered by said guard rail.

* * * * *